US011369186B1

(12) United States Patent
Dixon et al.

(10) Patent No.: US 11,369,186 B1
(45) Date of Patent: Jun. 28, 2022

(54) CREDIT CARD/IDENTITY CARD HOLDER

(71) Applicants: Alveon Dixon, Parkville, MD (US); Cyrus Robert Etemad-Moghadam, Fallston, MD (US); Drew Harlacher, Delta, PA (US)

(72) Inventors: Alveon Dixon, Parkville, MD (US); Cyrus Robert Etemad-Moghadam, Fallston, MD (US); Drew Harlacher, Delta, PA (US)

(73) Assignee: Full Coverage Security Solutions, LLC, Perry Hall, MD (US)

( * ) Notice: Subject to any disclaimer, the term of this patent is extended or adjusted under 35 U.S.C. 154(b) by 401 days.

(21) Appl. No.: 16/512,425

(22) Filed: Jul. 16, 2019

(51) Int. Cl.
*A45C 11/18* (2006.01)
*A45F 5/00* (2006.01)
*G09F 3/20* (2006.01)

(52) U.S. Cl.
CPC ..... *A45F 5/00* (2013.01); *A45C 11/182* (2013.01); *G09F 3/207* (2013.01); *A45F 2200/055* (2013.01)

(58) Field of Classification Search
CPC ..... G09F 3/207; A45C 11/182; A45C 1/06; A45C 2001/065; A45C 2001/067; A45C 11/18; A45C 2011/188; A45C 2011/186
USPC ..... 150/147, 149
See application file for complete search history.

(56) References Cited

U.S. PATENT DOCUMENTS 1,934,629 A * 11/1933 Reilly ..... A24F 15/12 206/256
2,634,777 A 4/1954 Berger
3,446,260 A * 5/1969 Osher ..... A45C 1/06 150/147
3,999,317 A * 12/1976 Owens ..... A44C 3/00 40/1.5
4,825,395 A * 4/1989 Kinser, Jr. ..... H01H 13/702 16/366
5,452,793 A 9/1995 DiMeo, Jr. et al.
6,044,967 A * 4/2000 Painsith ..... A45C 11/00 206/234
6,871,682 B2 3/2005 Hogganvik
7,232,325 B2 6/2007 Richter et al.
7,347,325 B2 * 3/2008 O'Neill ..... A45C 1/06 206/38

(Continued)

FOREIGN PATENT DOCUMENTS

CN 205624939 10/2016
GB 2471197 12/2010

(Continued)

*Primary Examiner* — Adam J Waggenspack
(74) *Attorney, Agent, or Firm* — Joseph E. Maenner; Maenner & Associates, LLC

(57) ABSTRACT

A card holder includes a first compartment sized to retain a credit card. The first compartment includes a frame and a rear support wall attached to the frame. A cover is pivotally attached to a lower portion of the support wall and pivotable between an open position. The support wall is uncovered and a closed position wherein the support wall is covered. A release mechanism is mounted on the frame and operable between a retaining position wherein the release mechanism retains the cover in the closed position and a release position wherein the release mechanism releases the cover such that the cover is pivotable to the open position.

12 Claims, 11 Drawing Sheets

(56) References Cited

U.S. PATENT DOCUMENTS

| | | | | |
|---|---|---|---|---|
| 8,567,459 | B2 * | 10/2013 | Kitchen | A45C 11/182 150/147 |
| 8,863,793 | B2 * | 10/2014 | Black | A45C 1/06 150/148 |
| 8,938,856 | B1 * | 1/2015 | Shin | E05D 3/06 16/366 |
| 8,985,387 | B2 | 3/2015 | Kobayashi | |
| 9,259,065 | B2 * | 2/2016 | Wingerter | A45C 1/02 |
| 9,615,641 | B2 | 4/2017 | Yeung et al. | |
| 9,685,986 | B2 * | 6/2017 | Lee | H04M 1/04 |
| 9,907,375 | B1 | 3/2018 | Kitchen | |
| 10,016,037 | B2 * | 7/2018 | Broly | A45C 13/002 |
| 10,098,430 | B2 * | 10/2018 | Pakr | A45C 15/00 |
| 10,236,928 | B2 * | 3/2019 | Tu | H04B 1/3888 |
| 10,716,376 | B2 * | 7/2020 | Buechin | A45C 11/00 |
| 10,973,293 | B2 * | 4/2021 | Armstrong | A45C 11/00 |
| 2004/0026275 | A1 | 2/2004 | Margetts et al. | |
| 2005/0155184 | A1 * | 7/2005 | Kayl | G06F 1/1681 16/366 |
| 2007/0284264 | A1 * | 12/2007 | Davis | A45C 11/182 206/39 |
| 2008/0149525 | A1 * | 6/2008 | Horiuchi | B65D 5/10 206/555 |
| 2014/0097102 | A1 * | 4/2014 | Piatt | A45C 11/00 206/37 |
| 2016/0120218 | A1 * | 5/2016 | Schennum | A24F 40/95 206/266 |

FOREIGN PATENT DOCUMENTS

| | | |
|---|---|---|
| WO | 2007080406 | 7/2007 |
| WO | 2014195837 | 12/2014 |

* cited by examiner

CREDIT CARD/IDENTITY CARD HOLDER

BACKGROUND OF THE INVENTION

Field of the Invention

The present invention relates to a case that is used to store a plurality of identification cards and/or other types of cards and to allow selective display of only one of a plurality of cards at a time.

Description of the Related Art

Numerous devices have been developed to store and protect credit cards and/or identity cards, such as driver's licenses or work identification cards. Some people, such as contractors who support multiple companies or organizations, have multiple work identification cards (one for each organization that is being supported). However, it may be advantageous for such a person to be able to carry the identification cards together, but to only show one card at a time, while shielding the other card(s) from view.

It would be beneficial to provide a card holder that can enable a person to be able to carry the identification cards together, but to only show one card at a time, while shielding the other card(s) from view.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a card holder comprising a first compartment sized to retain a credit card. The first compartment includes a frame and a rear support wall attached to the frame. A cover is pivotally attached to a lower portion of the support wall and pivotable between an open position. The support wall is uncovered and a closed position wherein the support wall is covered. A release mechanism is mounted on the frame and operable between a retaining position wherein the release mechanism retains the cover in the closed position and a release position wherein the release mechanism releases the cover such that the cover is pivotable to the open position.

In an alternative embodiment, a card holder comprises a frame, a support wall attached to the frame, and a first compartment on a first side of the support wall. A second compartment is located on an opposing side of the support wall and a cover is pivotally attached to the frame and is pivotable between a first closed position, wherein the first compartment is covered and a second closed position, wherein the second compartment is covered.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
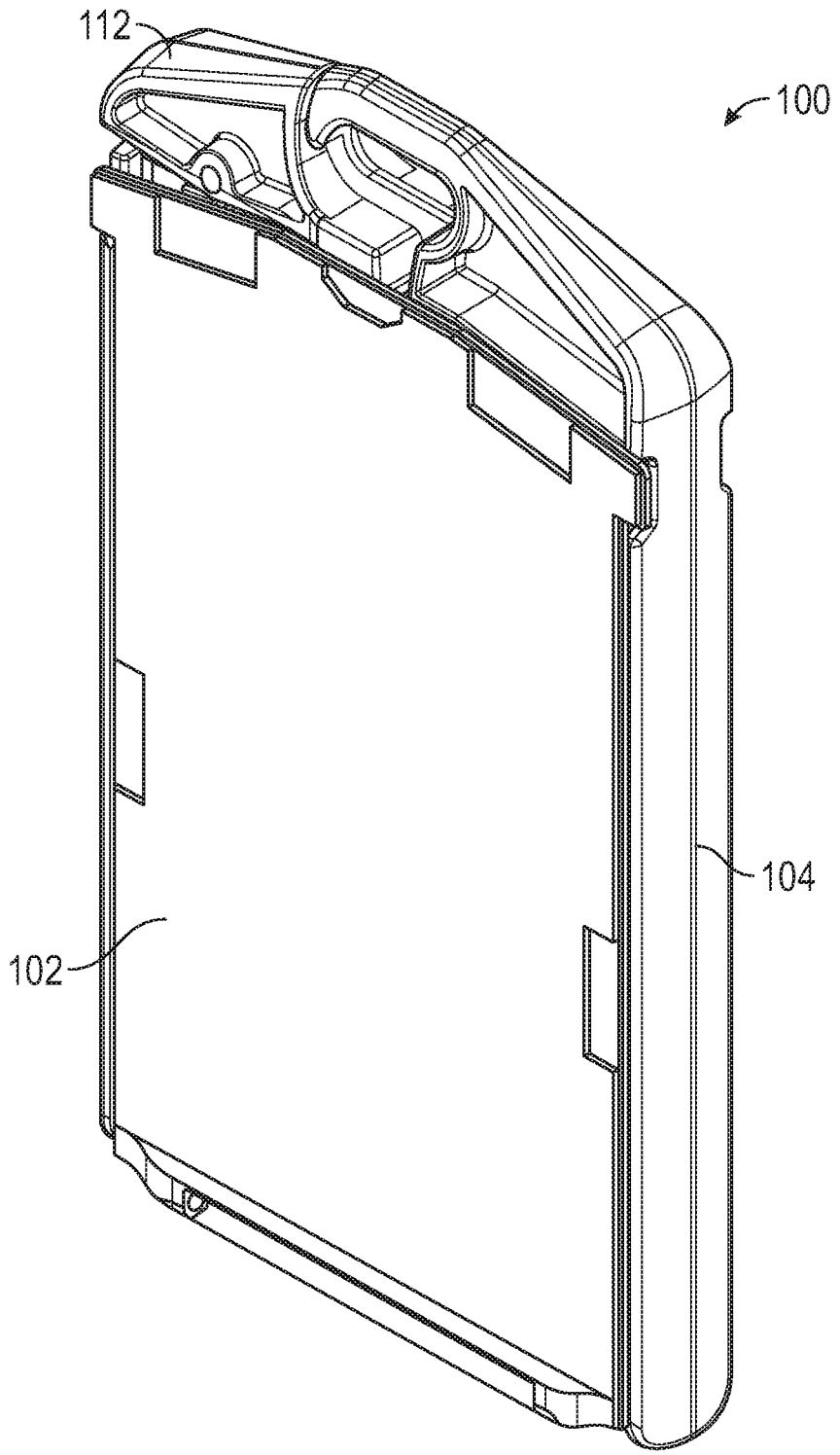
FIG. 1 is perspective view of a card holder according to an exemplary embodiment of the present invention, with the card holder in a closed position.
Figure 1A:
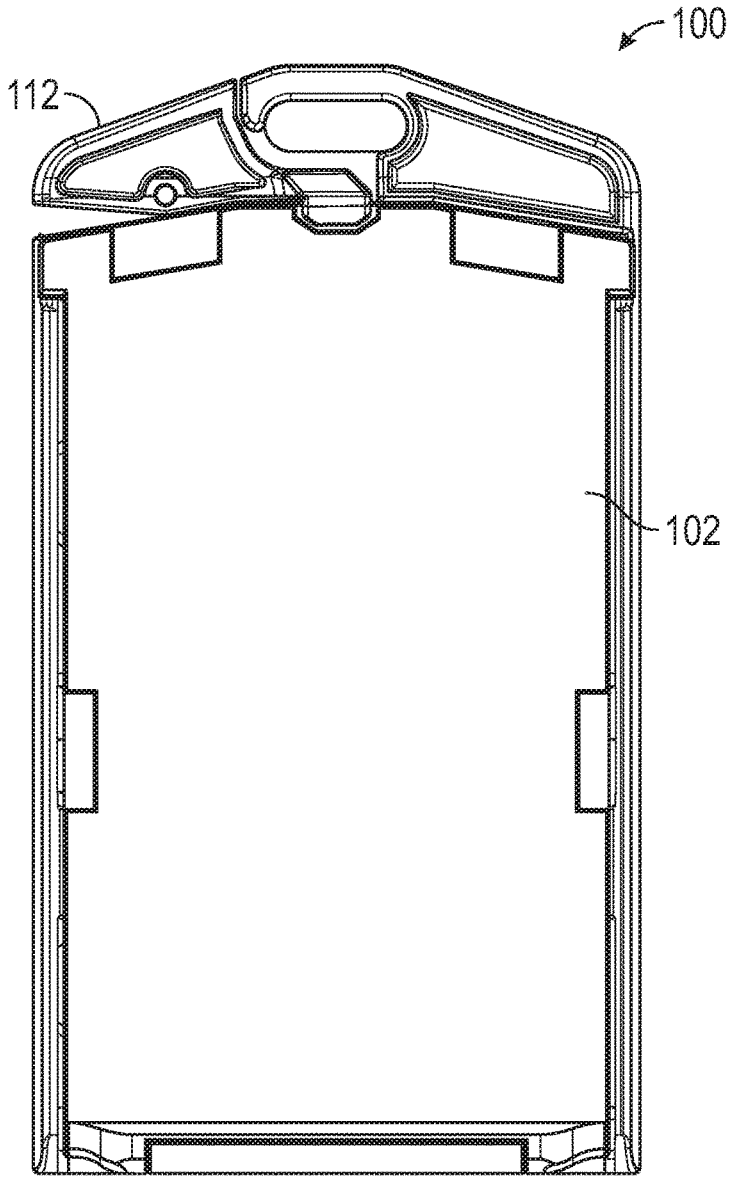
FIG. 1A is a front elevational view of the card holder of FIG. 1.
Figure 1B:
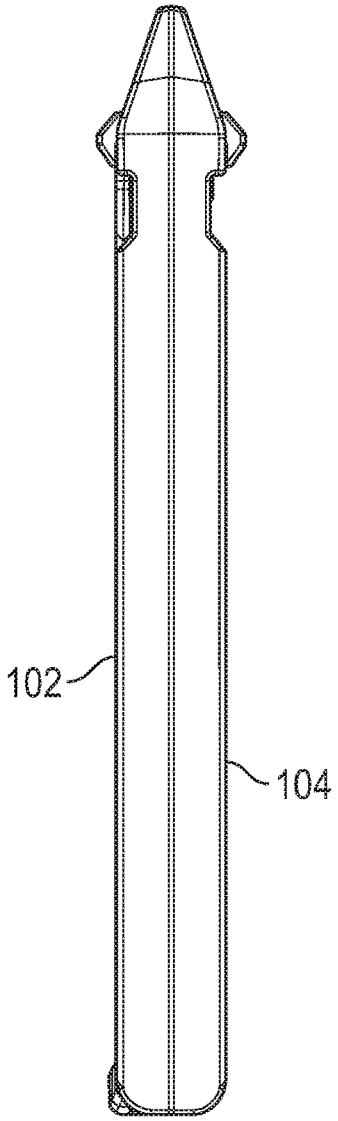
FIG. 1B is a side elevational view of the card holder of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention is a credit card and/or identity card holder 100 that is used to store cards and can also be used to only display a single card at a time. Holder 100 can be constructed from molded plastic, or other suitable material. In some embodiments, holder 100 or parts of holder 100 can be constructed from a material that can block radio frequency waves from passing through.

Holder 100 has a first compartment 110 that can hold at least one credit card or identity card 50 and a second compartment 111 that can also hold at least one credit card or identity card 50'. First compartment 110 and second compartment 111 are separated by a central support wall 120. Central support wall 120 has a first face 123 that forms the rear wall of first compartment 110. Second compartment 111 is a mirror image of first compartment 110, with central support wall 120 having an opposing face (not shown) that forms the rear wall of second compartment 111. Only first compartment 110 will be described in detail, with all of the attributes of first compartment 110 being present in second compartment 111.

Figure 1C:
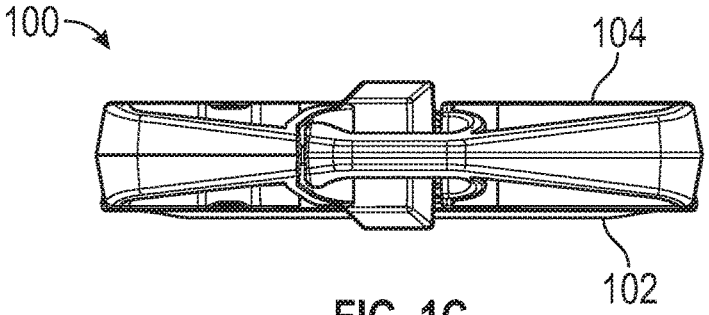
FIG. 1C is a top plan view of the card holder of FIG. 1.

Referring to FIGS. 1-1C, holder 100 is in a closed condition. First compartment 110 includes a cover 102 that is hingedly connected to a rigid body frame 104. Cover 102 can be rotated about the bottom of support wall 120 such that cover 102 can alternatively cover first compartment 110 or second compartment 111. A release mechanism 112 is located at a top corner of holder 100 and can be activated to releasably engage cover 102 so that cover 102 is secured to frame 104 or disengage cover 102 so that cover 102 can be opened along a hinge assembly 106. Hinge assembly 106 includes a hinge plate 122 as shown in FIGS. 2-2C.

Figure 2:
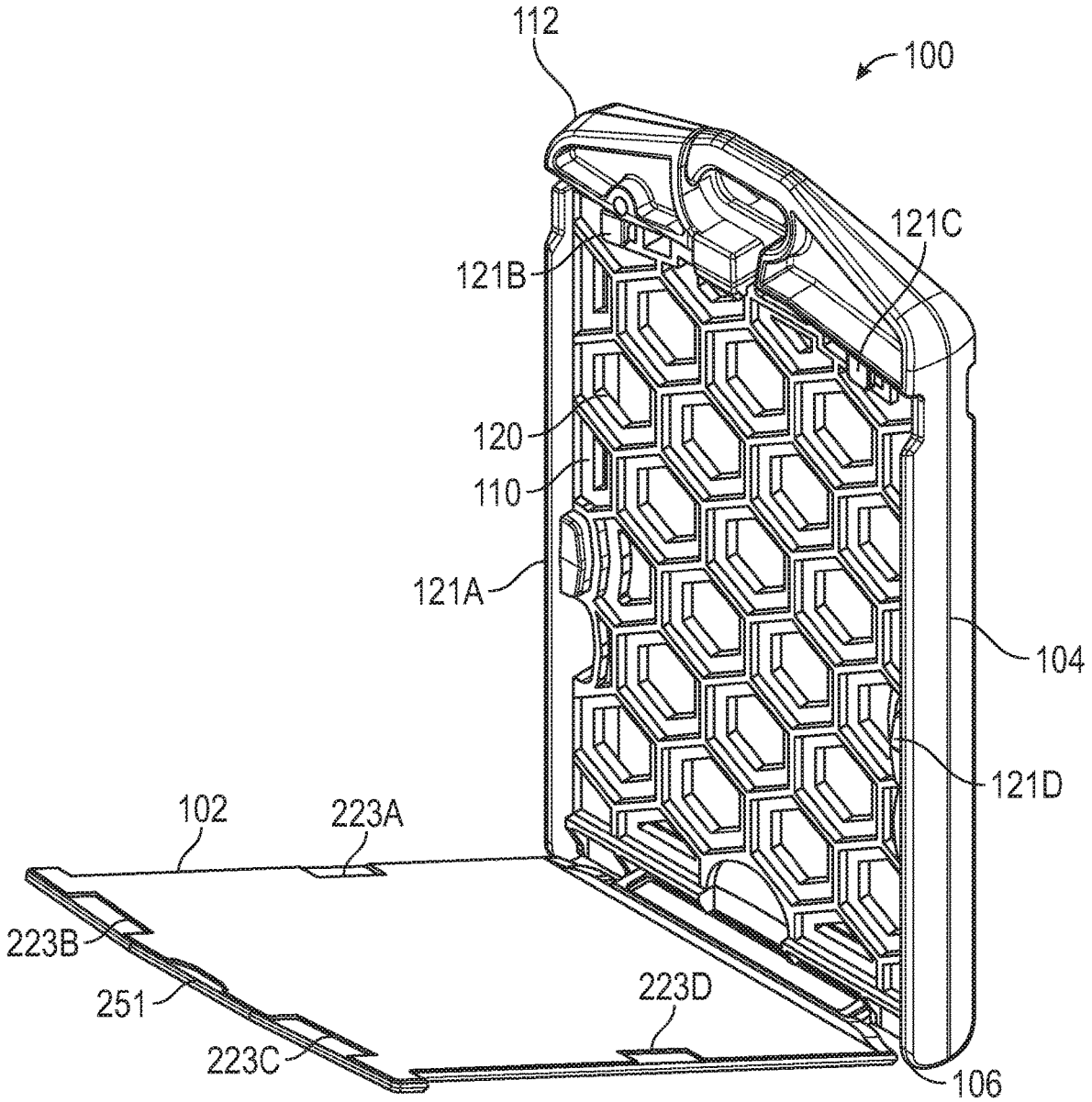
FIG. 2 is a perspective view of the card holder of FIG. 1, in an open position.
Figure 2A:
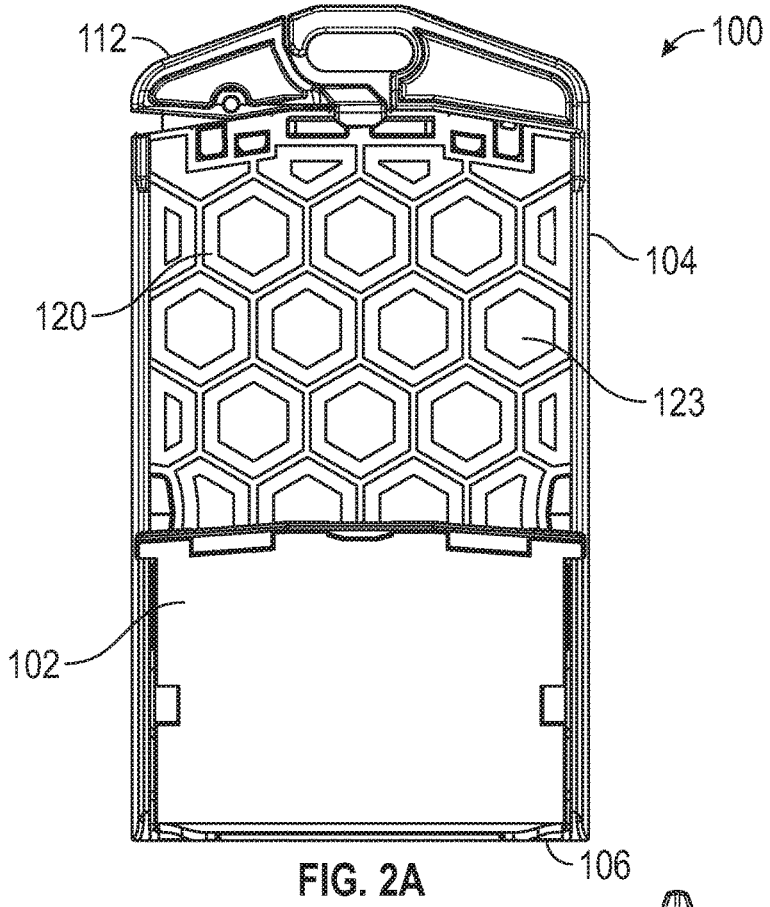
FIG. 2A is a front elevational view of the card holder of FIG. 2.
Figure 2B:
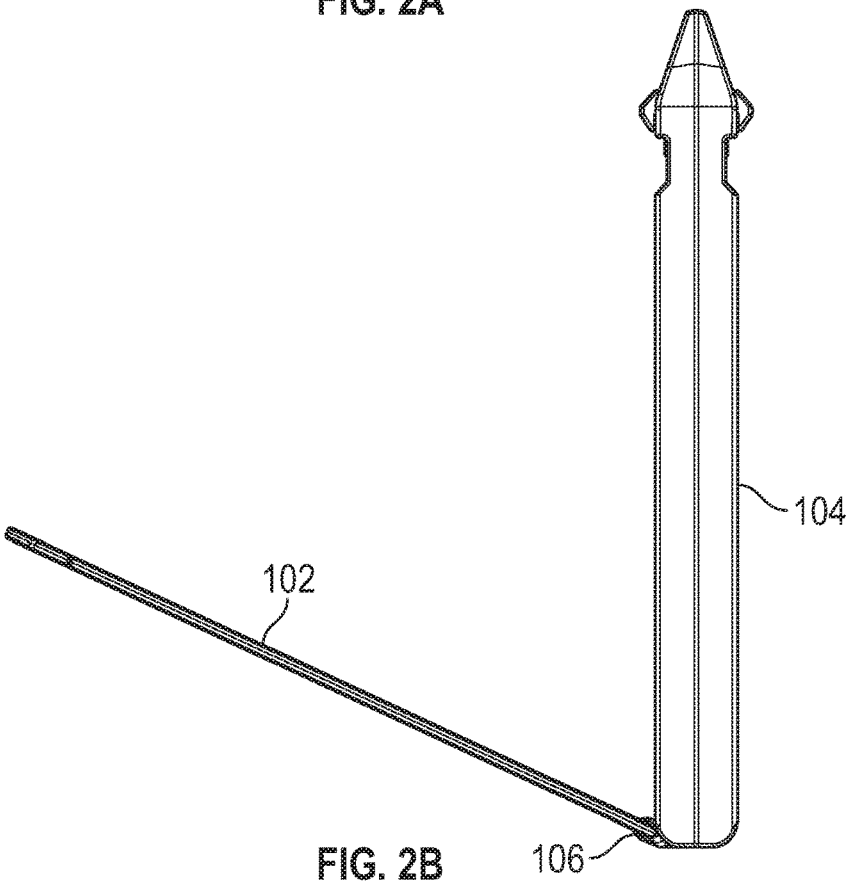
FIG. 2B is a side elevational view of the card holder of FIG. 2.
Figure 2C:
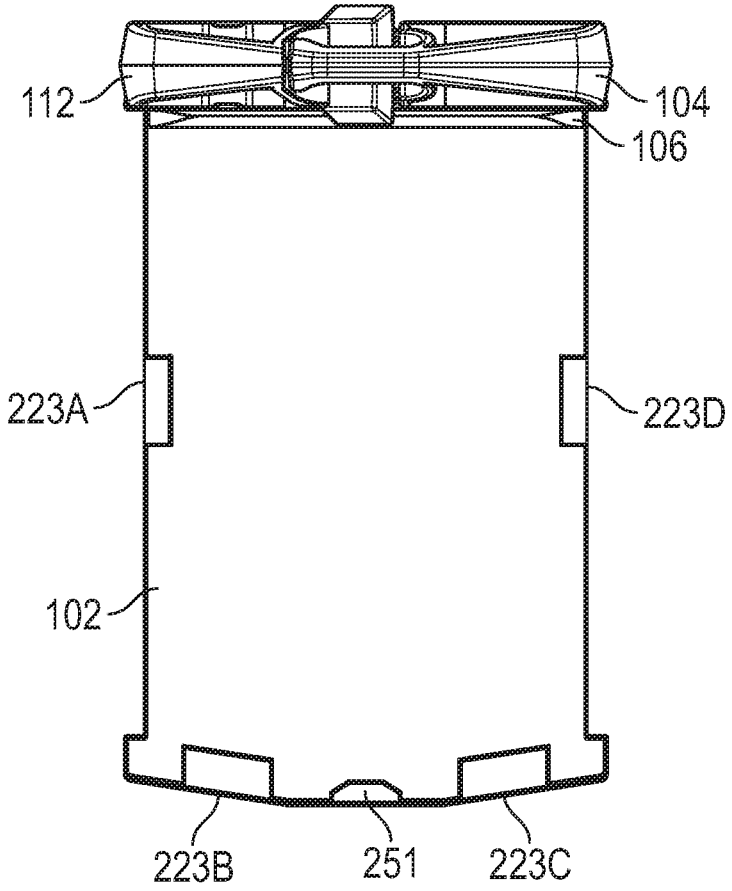
FIG. 2C is a top plan view of the card holder of FIG. 2.

As can be seen in FIGS. 2 and 2A, frame 104 includes a honeycombed support wall 120 for strength. Further, support wall 120 can be hollow within each honeycomb to reduce material cost and weight.

A plurality of card retainers 121A-D are spaced around an internal periphery of frame 104 to retain card 50 within holder 100 when card 50 is inserted into holder 100. Cover 102 includes a plurality of indents 124A-D to provide pockets to receive respective card retainers 121A-D. A reverse side of cover 102 includes a like plurality of indents 223A-D (shown in FIGS. 2 and 2C) for when cover 102 is rotated to cover second compartment 111.

Figure 3:
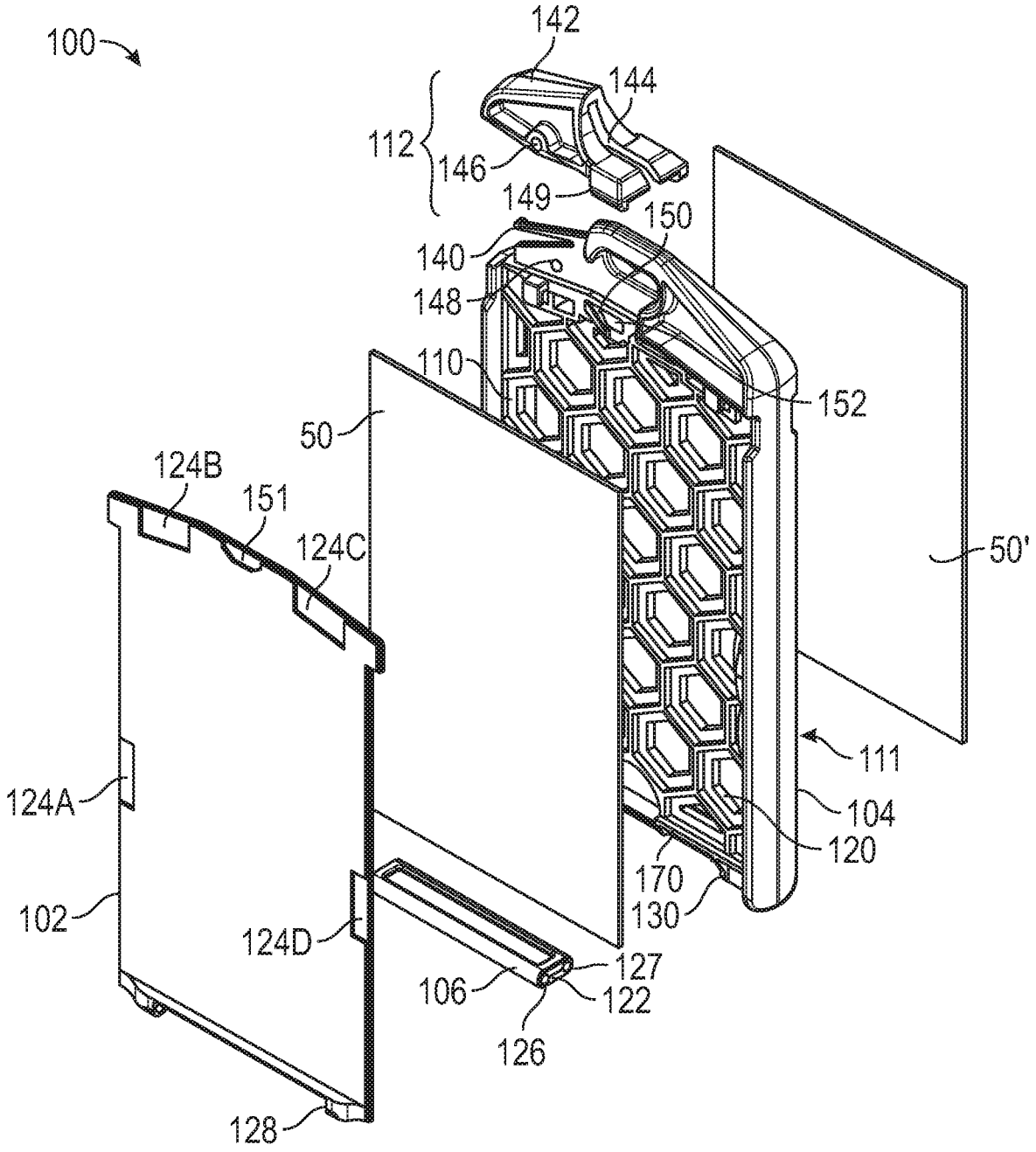
FIG. 3 is an exploded view of the card holder of FIG. 1.

FIG. 3 shows an exploded view of holder 100 with a credit card 50 inserted therein. Hinge assembly 106 includes a hinge plate 122 with indents 126, 127 on either side that receive pins 128, 130 in cover 102 and frame 104, respectively so that cover 102 is pivotable about hinge plate 122 and hinge plate 122 is also pivotable about support wall 120.

Figure 4:
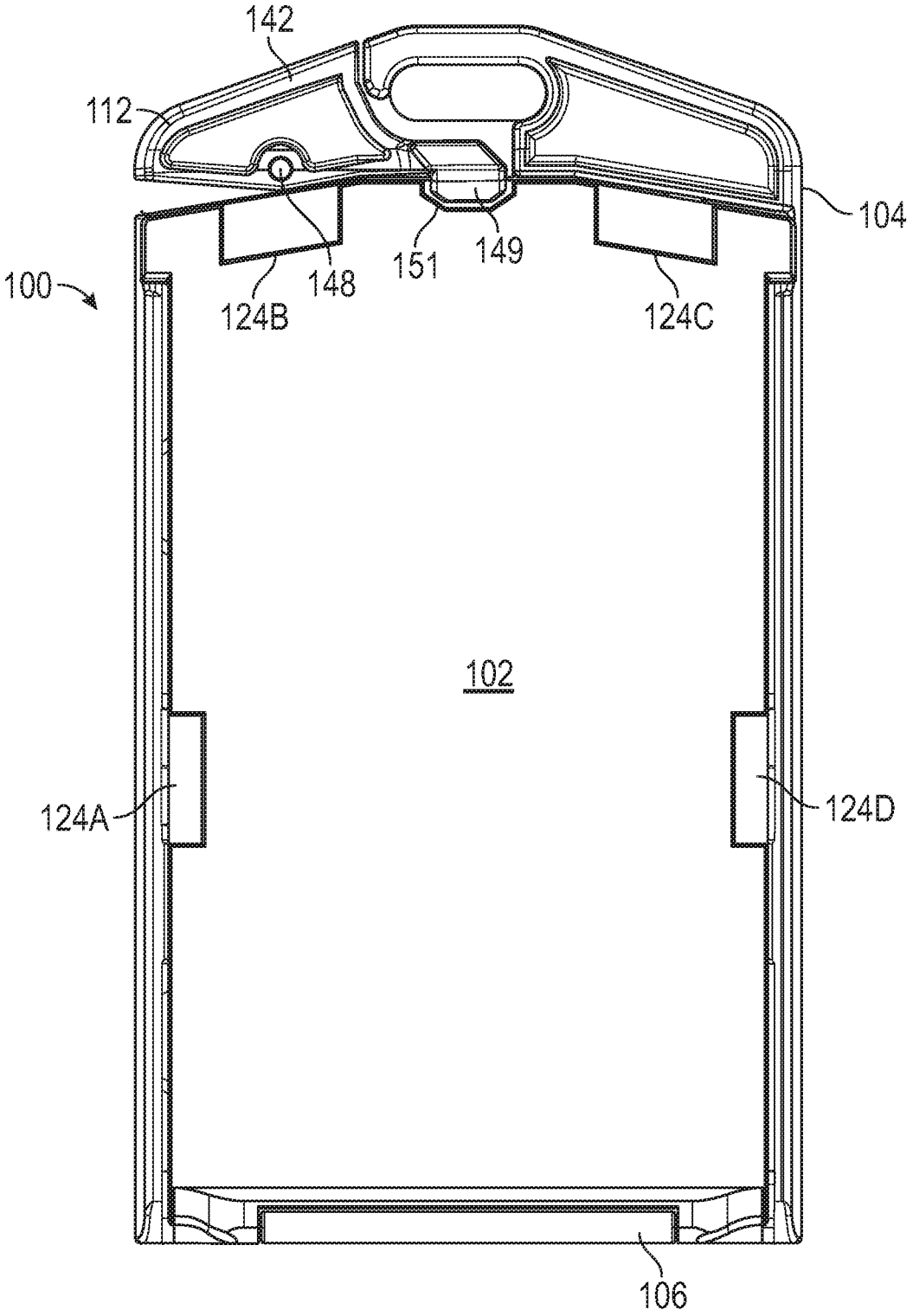
FIG. 4 is a front elevational view of the card holder of FIG. 1, with a release mechanism in a retaining position.

Release mechanism 112 includes a biasing arm 140 fixed to frame 104 and a pivoting lock and release member 142 having a slot 144 into which biasing arm 140 is inserted. Lock and release member 142 disposed over biasing arm 140 and is pivotally attached to frame 104 at a pivot point 146 with a corresponding pivot attachment 148 on frame 104. Lock and release member 142 includes a locking arm 149 that engages a recess 151 in the top of cover 102 to retain cover 102 in the closed position, as shown in FIG. 4. Similarly, a reverse side of cover 102 includes a recess 251 (shown in FIGS. 2 and 2C) for when cover 102 is rotated to cover second compartment 111.

Frame 104 also includes a push pin 150 that is normally biased outwardly, as shown in FIG. 3. When holder 100 is opened to remove or insert card 50, push pin 150 pushes the top of cover 102 outwardly so that cover 102 can pivot about hinge assembly 106 and card 50 can be removed from holder 100.

Figure 5:
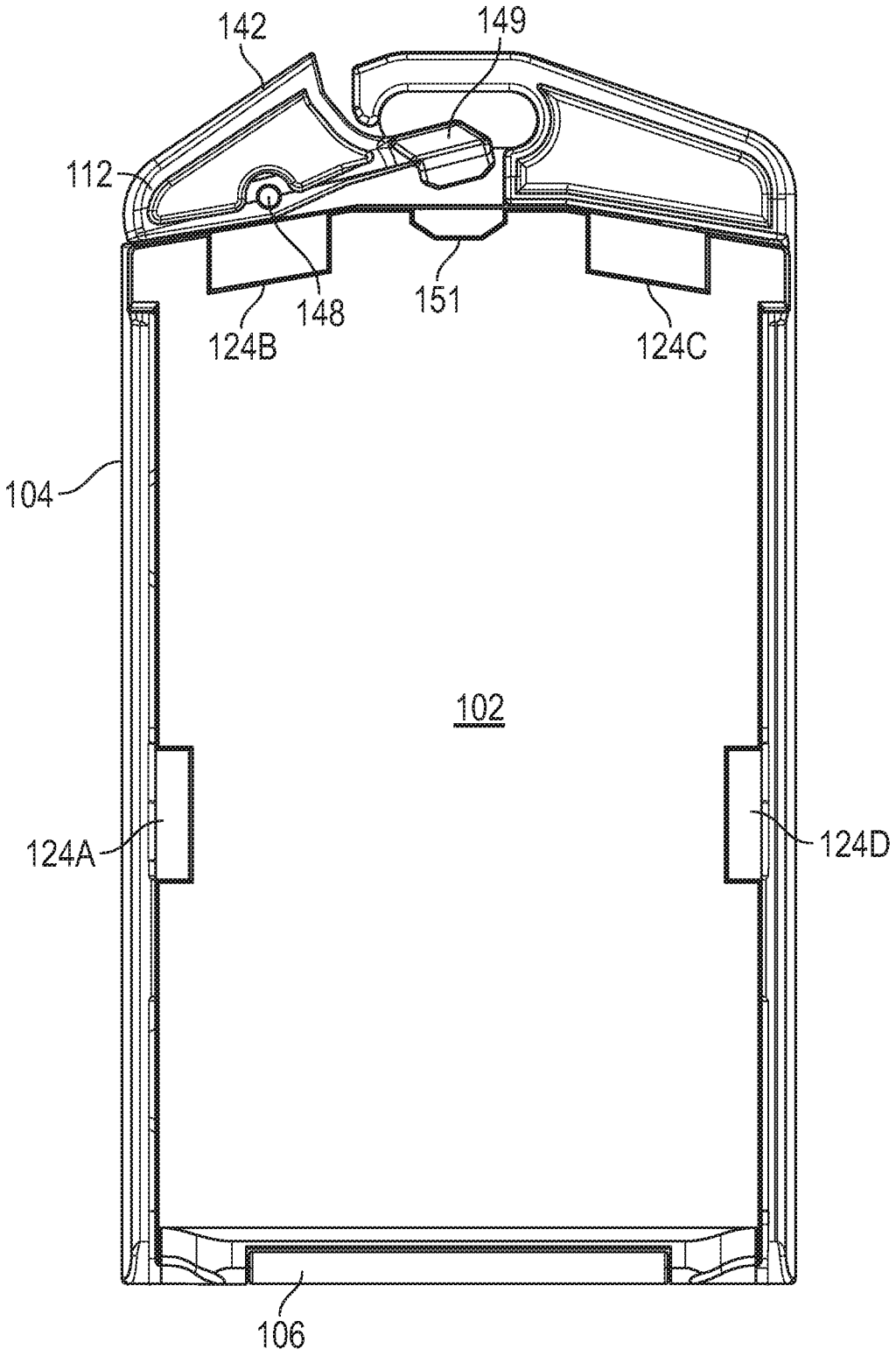
FIG. 5 is a front elevational view of the card holder of FIG. 1, with a release mechanism in a release position.

FIG. 4 shows holder 100 with release member 142 of release mechanism 112 in a locked position wherein locking arm 149 is in front of cover 102 to prevent cover 102 from pivoting to an open position. When release member 142 of release mechanism 112 is biased to an open position, as shown in FIG. 5, release member 142 pivots about pivot attachment 148 and locking arm 149 is biased away from cover 102 so that push pin 150 can push cover 102 to pivot to an open position, such as is shown in FIG. 2 (without card 50 shown).

Figure 6:
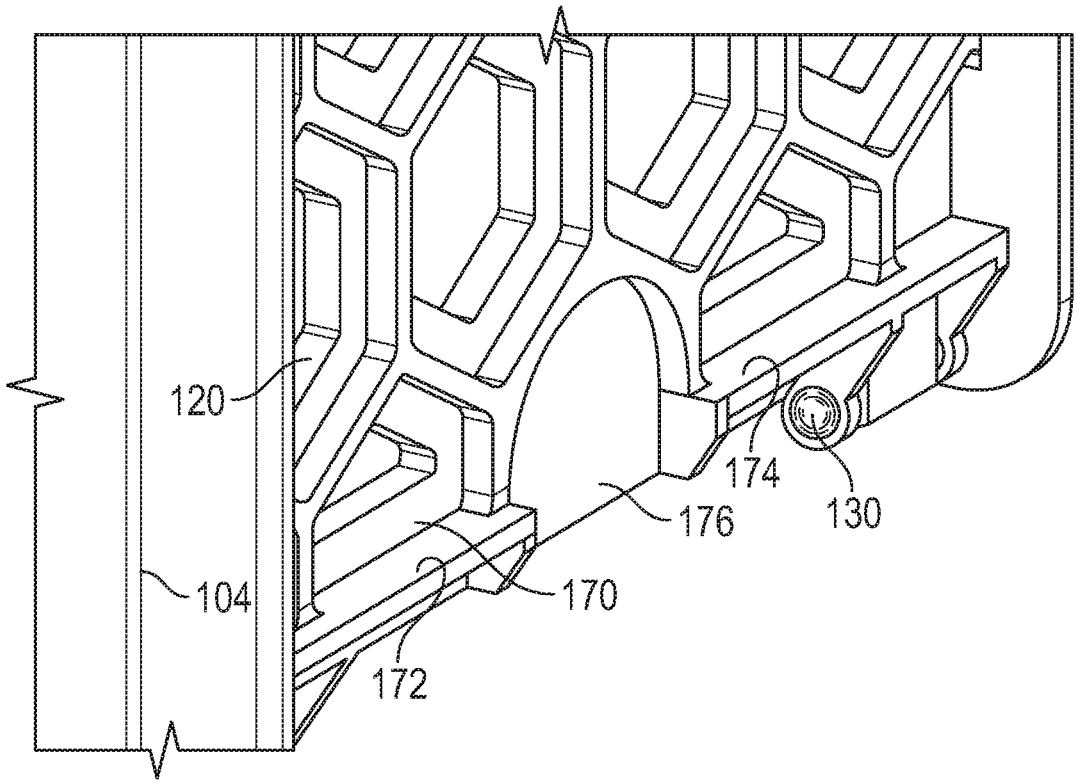
FIG. 6 is a perspective view of a lower portion of the card holder of FIG. 1, with the cover removed.

Referring to FIG. 6, a lower ledge 170 extends outwardly from support wall 120 and is adapted to receive an edge of the credit card 50 when card 50 is inserted into holder 100. Lower ledge 170 comprises a first ledge portion 172 and a second ledge portion 174, with a pocket 176 provided between first ledge portion 172 and second edge portion 174. Pocket 176 is sized so that a user can insert a finger and grasp card 50 to slide card 50 from holder 100.

Figure 7B:
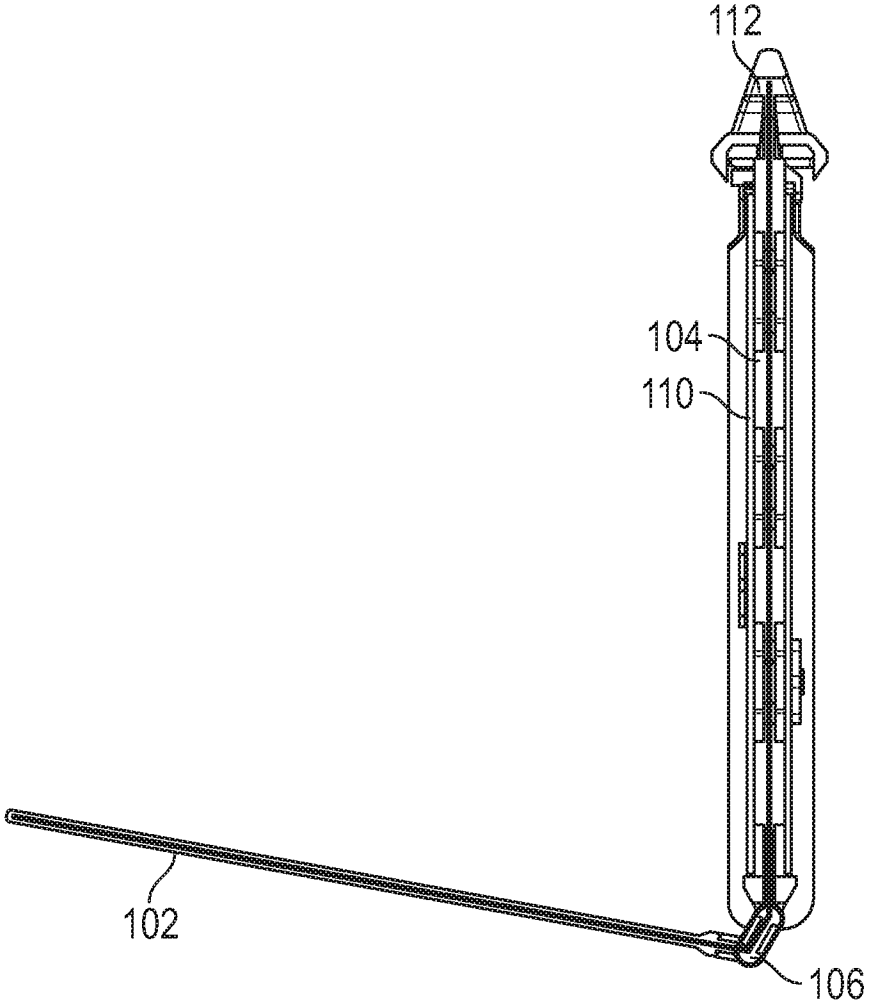
FIG. 7B is a side elevational view of the card holder of FIG. 7A, with the cover open to reveal the first compartment.
Figure 7A:
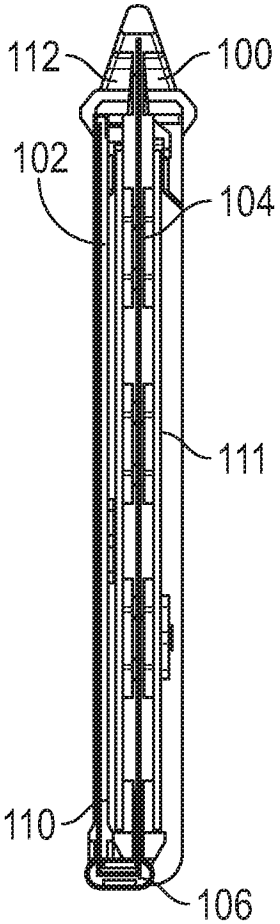
FIG. 7A is a side elevational view of the card holder of FIG. 1, with the cover covering a first compartment.

FIGS. 7A-7D show an exemplary operation of holder 100 when moving cover 102 from covering first compartment 110 to covering second compartment 111, as well as the operation of hinge assembly 106. As shown in FIG. 7A, cover 102 covers first compartment 110 and hinge assembly 106 extends in a horizontal position under first compartment 110.

In FIG. 7B, release mechanism 112 releases cover 102 so that cover 102 can open to reveal first compartment 110. Hinge assembly 106 begins to rotate about the bottom of frame 104.

Figure 7D:
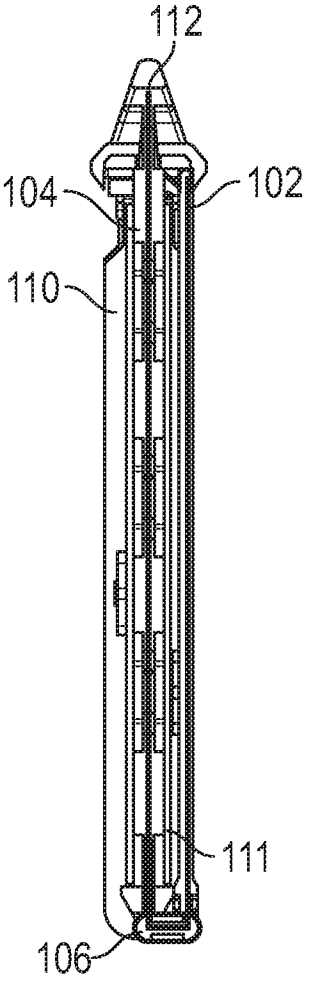
FIG. 7D is a side elevational view of the card holder of FIG. 7A, with the cover closed over the second compartment.
Figure 7C:
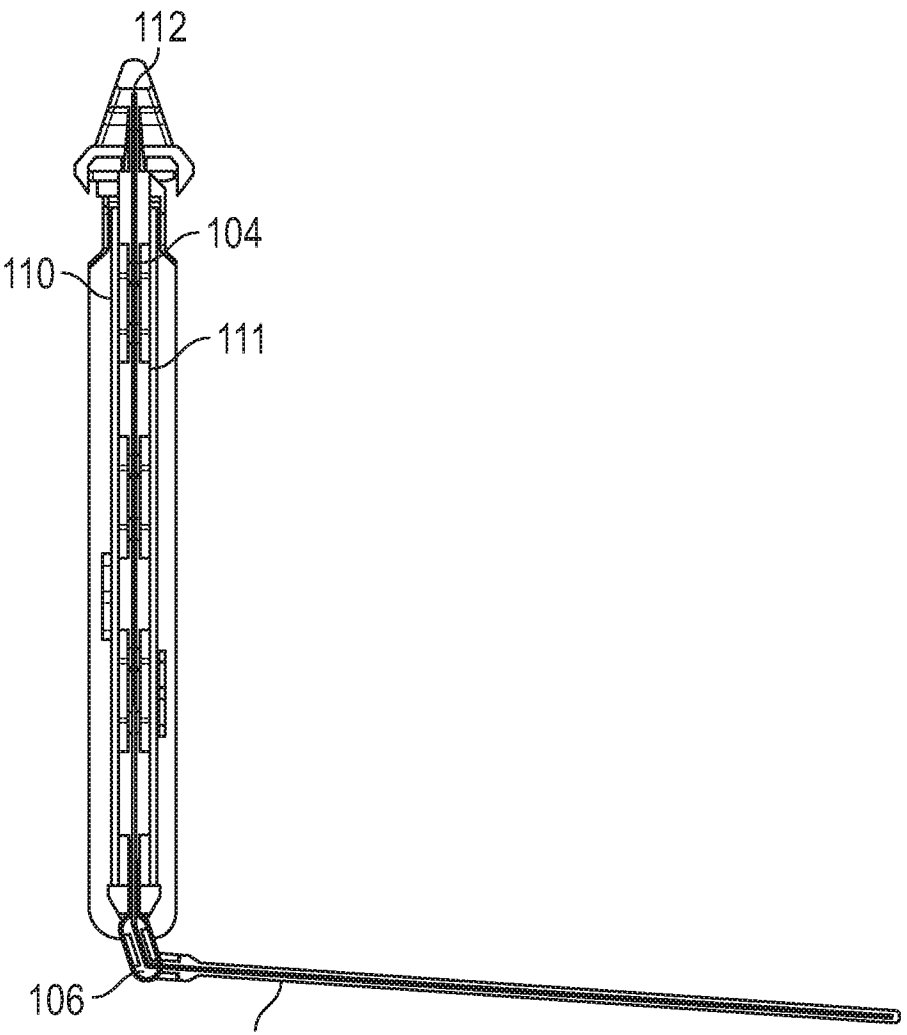
FIG. 7C is a side elevational view of the card holder of FIG. 7A, with the cover flipped to begin to cover the second compartment.

In FIG. 7C, cover 102 has rotated past the bottom of frame 104 and is beginning to rotate upwardly to cover second compartment 111. Hinge assembly 106 has rotated past the bottom of frame 104 and is starting to rotate upwardly with cover 102.

In FIG. 7D, cover 102 has been closed over second compartment 111 and hinge assembly 106 has rotated to a horizontal position under second compartment 111. Release mechanism 112 has returned to its locked position to hold cover 102 in its closed position over compartment 111.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A card holder comprising:

a first compartment sized to retain a credit card, the first compartment comprising:

a frame having a lower portion;

a rear support wall attached to the frame wherein the rear support wall has an opposing face;

a cover pivotally attached to a lower portion of the frame and pivotable between an open position, wherein the support wall is uncovered and a closed position wherein the support wall is covered;

a release mechanism mounted on the frame and operable between a retaining position wherein the release mechanism retains the cover in the closed position and a release position wherein the release mechanism releases the cover such that the cover is pivotable to the open position; and a second compartment disposed on the opposite face of the support wall, wherein the first compartment has a first opening opposite the rear support wall and the second compartment has a second opening opposite the opposing face of the rear support wall, wherein the cover is pivotable about the lower portion of the frame between the first compartment and the second compartment to alternatively cover one of the first opening and the second opening.

2. The card holder according to claim 1, further comprising a lower ledge extending outwardly from the rear support wall and adapted to receive an edge of the credit card.

3. The card holder according to claim 2, wherein the lower ledge comprises a first ledge portion and a second ledge portion, and wherein a pocket is provided between the first ledge portion and the second ledge portion.

4. The card holder according to claim 1, wherein the release mechanism comprises a biasing member fixed to the frame.

5. The card holder according to claim 4, further comprising a pivoting and release member pivotally attached to the frame and disposed over the biasing member.

6. The card holder according to claim 5, wherein the pivoting and release member includes a locking arm adapted to engage the cover in the closed position.

7. The card holder according to claim 6, wherein the cover comprises a recess adapted to receive the locking arm when the cover is in the closed position.

8. The card holder according to claim 1, further comprising a push pin extending from the frame such that, when the cover is in the closed position and the release mechanism is in the retaining position, the pivot pin is disposed in the frame and, when the release mechanism is in the release position, the push pin pushes the cover toward the open position.

9. A card holder comprising:

a frame;

a support wall attached to the frame;

a first compartment on a first side of the support wall;

a second compartment on an opposing side of the support wall;

a cover pivotally attached to the frame and pivotable between a first closed position, wherein the first compartment is covered and a second closed position, wherein the second compartment is covered;

a release mechanism mounted on the frame and engageable with the cover when the cover is the first closed position and also when the cover is in the second closed position, wherein the release mechanism comprises a biasing member fixed to the frame; and a pivoting and release member pivotally attached to the frame and disposed over the biasing member, wherein the pivoting and release member includes a locking arm adapted to engage the cover in the closed position, wherein the cover comprises a first recess adapted to receive the locking arm when the cover is in the first closed position and a second recess adapted to receive the locking arm when the cover is in the second closed position.

10. The card holder according to claim 9, wherein the support wall is constructed in a honeycomb shape.

11. The card holder according to claim 9, further comprising a hinge plate pivotally attached to the cover.

12. The card holder according to claim 9, further comprising a hinge plate pivotally attached to the frame.

* * * * *